US005704126A

United States Patent [19]

Franke et al.

[11] Patent Number: 5,704,126

[45] Date of Patent: Jan. 6, 1998

[54] DRY SHAVING APPARATUS WITH A PIVOTALLY MOUNTED LONG-HAIR TRIMMER

[75] Inventors: Wolfgang Franke, Langen; Hans-Dieter Klauer, Oberursel, both of Germany

[73] Assignee: Braun Aktiengesellschaft, Frankfurt, Germany

[21] Appl. No.: 528,058

[22] Filed: Sep. 14, 1995

Related U.S. Application Data

[63] Continuation of Ser. No. 174,395, Dec. 23, 1993, abandoned.

[30] Foreign Application Priority Data

Dec. 24, 1992 [DE] Germany ..... 42 44 164.1

[51] Int. Cl.[6] ..... B26B 19/06

[52] U.S. Cl. ..... 30/34.1; 30/43.91; 30/346.51

[58] Field of Search ..... 30/34.1, 43.9, 30/43.92, 43.91, 346.51

[56] References Cited

U.S. PATENT DOCUMENTS

| | | | |
|---|---|---|---|
| 2,629,169 | 2/1953 | Kleinman | 30/43.92 X |
| 2,780,864 | 2/1957 | Kleinman | 30/43.92 X |
| 3,827,144 | 8/1974 | Arpino | 30/43.92 X |
| 3,911,572 | 10/1975 | Czerner et al. | 30/34.1 |
| 3,967,372 | 7/1976 | Beck et al. | 30/43.1 X |
| 4,274,199 | 6/1981 | Gallanis et al. | 30/34.1 |
| 4,797,997 | 1/1989 | Packham et al. . | |
| 5,185,926 | 2/1993 | Locke | 30/43.92 |

FOREIGN PATENT DOCUMENTS

| | | |
|---|---|---|
| 1 159 309 | 6/1964 | Germany . |
| 1553659 | 6/1967 | Germany . |
| 43 13 371 A1 | 4/1993 | Germany . |
| 4-132581 | 6/1992 | Japan . |

*Primary Examiner*—Maurina T. Rachuba
*Attorney, Agent, or Firm*—Fish & Richardson P.C.

[57] ABSTRACT

A dry shaving apparatus includes housing structure, a drive mechanism in the housing structure; at least two elongated cutter heads (SK1, SK2) that extend in longitudinal directions essentially parallel with each other, each cutter head comprising an outer cutter and an inner cutter and the two cutter heads being movable relative to and essentially parallel with each other. A further cutter head (SK3) is arranged intermediate the two cutter heads (SK1, SK2) so as to be pivotal about an axis (Z) extending parallel with the longitudinal directions of the two elongated cutter heads (SK1, SK2).

19 Claims, 6 Drawing Sheets

SK3
SK1
68
1
67
14
69
SK2
66
2
48
SK3
36
33
34
47
80
59
81
60
61
64
43
62
49
63
45
58

DRY SHAVING APPARATUS WITH A PIVOTALLY MOUNTED LONG-HAIR TRIMMER

This is a continuation of application Ser. No. 08/174,395, filed Dec. 23, 1993, now abandoned.

This invention relates to a dry shaving apparatus with a drive mechanism provided in a housing, at least two cutter heads extending in the longitudinal direction essentially parallel with each other and comprising each an upper cutter and an inner cutter and being movable relative to and essentially parallel with each other.

BACKGROUND OF THE INVENTION

A dry shaving apparatus of the type initially referred to is known from U.S. Pat. No. 4,797,997. The two upper cutters of the parallel cutter heads have their respective ends coupled to a parallelogram whose transverse link members are pivotally connected to end walls of a common frame in order to effect a parallel relative movement of the two cutter heads. The inner cutters operatively associated with the upper cutters are pivotally connected to a coupling member and are urged into engagement with the associated upper cutter by a respective spring. The coupling member is coupled to the drive mechanism of the shaving apparatus for the purpose of transmitting an oscillating movement to the two inner cutters.

A dry shaving apparatus of the type initially referred to is further known from JP-4-1 32 581 A. The two upper cutters of the parallel cutter heads are spring-mounted, each separately, in a common exchangeable frame, such that, on the application of forces of different magnitudes acting from outside on the upper cutters, each of the upper cutters will perform a corresponding movement relative to the other upper cutter. The two inner cutters of the cutter heads are each spring mounted on a coupling member coupled to the drive mechanism of the shaving apparatus, with the springs provided in this arrangement serving the function of urging the inner cutters into engagement with the upper cutters, in addition to permitting relative movement of the upper cutters.

From DE-OS 15 53 659 a dry shaving apparatus is known having three cutter heads arranged parallel with each other. The cutter head configured as a long-hair trimmer provided with sharp-edged cutting teeth is arranged so as to be advanced intermediate the two outer cutter heads configured as short-hair cutters, in order to enable the contours of hair to be trimmed.

SUMMARY OF THE INVENTION

It is an object of the present invention to improve the cutter assembly of a dry shaving apparatus of the type referred to above.

According to the present invention, this object is accomplished in that a further cutter head is arranged intermediate the two outer cutter heads so as to be pivotal about an axis Z extending parallel with the two outer cutter heads.

The solution of the present invention affords several advantages. It enables the arrangement of a further cutter head intermediate two outer cutter heads movable relative to and parallel with each other and ensures, by means of the pivotal mounting of the cutter head provided intermediate the two relatively movable outer cutter heads, an adaptation of its cutting area to the shearing plane which is defined by the angular position of a tangent applied to the outer contours of the outer cutter heads movable relative to each other. Among other aspects, it is an essential advantage of the present invention that the effective cutting area of the pivotally mounted cutter head may perform a cutting function different from that of the two outer cutter heads movable relative to each other by configuring the pivotal head as a long-hair trimmer, for example, for the trimming of long hair resting against the skin, whereby the cutting of long hair and at the same time the cutting of short hair using the outer cutter heads movable relative to each other is ensured.

A preferred embodiment of the present invention is characterized in that the axis Z extends through the point of intersection SP of two straight lines T and G, where T is the common tangent to the outer contours of the two outer cutter heads SK1 and SK2, and G is a straight line intersecting the tangent T at right angles in the center of a distance A, where A is the relative distance of the tangent points TP1, TP2 of the tangent T to the respective outer contours of the two outer cutter heads SK1 and SK2.

A further feature of the present invention provides for the axis Z to extend approximately through the point of intersection SP of two straight lines T and G, where T is the common tangent to the outer contours of the two outer cutter heads SK1 and SK2, and G is a straight line intersecting the tangent T at right angles in the center of a distance A, where A is the relative distance of the tangent points TP1, TP2 of the tangent T to the respective outer contours of the two outer cutter heads SK1 and SK2.

In an advantageous embodiment of the present invention, on the application of an outside force on the cutter heads movable relative to each other, the shearing plane SE defined by the tangent T, as well as the intermediate cutter head are pivotal about the axis Z.

A very significant advantage of the present invention resides in that it enables two relatively movable cutter heads to be adapted to different systems of movement in a very straightforward manner. A simple and economical embodiment of the present invention is characterized in that the relative movement of the two outer cutter heads is controllable by means of a parallelogram to which at least one further lever is jointed for controlling the pivotal movement of the intermediate cutter head. The intermediate cutter head is preferably disposed on the lever.

In a further feature of the present invention, the cutter head pivotal about the axis Z is arranged to be movable with the axis Z relative to at least one of the two outer cutter heads. This embodiment of the present invention ensures an optimum adaptation of the pivotally mounted cutter head to relatively movable cutter heads arranged independently of each other and movable relative to each other.

In another feature of the last-mentioned embodiment, the relatively movable arrangement enables the position of the axis Z of the pivotally mounted cutter head to be variable in relation to the tangent applied to the outer contours of the two outer cutter heads on the exertion of an outside force acting on the intermediate cutter head.

In another feature of the two embodiments referred to in the foregoing, on the application of an outside force acting on at least one of the cutter heads, the pivot angle of the pivotally mounted cutter head corresponds substantially to the angle B formed by the tangent T applied to the outer contours of the two outer cutter heads, that is, the shearing plane SE, and a horizontal straight line H.

In still another feature of the present invention, the cutter head pivotal about the axis Z is configured as a long-hair trimmer.

As is known, in the prior art initially referred to the two relatively movable cutter heads are configured as short-hair cutters. The provision of the pivotally mounted cutter head configured as a long-hair trimmer arranged intermediate the short-hair cutters ensures automatically a combination shave, that is, short hair and long hair are cut at the same time.

In a preferred embodiment of the present invention, the upper cutter of the long-hair trimmer is of a substantially U-shaped configuration. The pivotal arrangement of the long-hair trimmer ensures that the planar outside of the upper cutter engages the skin, enabling it to move gently over the skin surface in order to introduce long hair into the effective cutting area between upper and inner cutter. An essential advantage of the U-shaped configuration of the upper cutter of the long-hair trimmer resides in that it can be moved over the skin surface in any direction in conjunction with the cutter heads configured as short-hair cutters without irritating the skin, being thus operative in the sense of performing a shearing action in any direction of movement.

According to the present invention, the cutter heads arranged parallel with the pivotally mounted cutter head are configured as short-hair cutters. In a further feature of the present invention, the pivotally mounted cutter head is coupled to a coupling means which is pivotal in a direction transverse to the longitudinal direction of the outer cutter heads and is coupled to a driving member effecting the oscillating movement.

According to a very economical aspect of the present invention, a coupling member driven by the drive mechanism of the dry shaving apparatus is provided, on which the cutter heads SK1, SK2 configured as short-hair cutters are arranged so as to be movable relative to each other, and which includes the driving member for the pivotally mounted cutter head SK3. Such a coupling member allows easy coupling to, and decoupling from, the drive mechanism of the dry shaving apparatus, as well as ease of manipulation in respect of the coupling to, and decoupling from, the inner cutters of the relatively movable cutter heads.

In another embodiment of the present invention, each of the cutter heads provided is associated with a respective coupling member coupled to the drive mechanism provided in the housing. When used, for example, in combination with a drive mechanism configured as a double eccentric, this embodiment permits an oscillating movement of one of the inner cutters in a direction opposite to at least one of the other inner cutters of the cutter heads provided.

In a further embodiment of the present invention, the cutter heads configured as short-hair cutters are relatively movably arranged on a common coupling member coupled to a drive mechanism. This embodiment permits an oscillating movement of the inner cutter of the pivotally mounted cutter head in a direction opposite to that of the inner cutters of the relatively movable cutter heads configured as short-hair cutters.

Some embodiments of the present invention will be described in the following with reference to the accompanying drawings. In the drawings, FIG. 1 is a schematic illustration of a cutter head assembly incorporating a parallelogram for controlling the cutter heads;

DESCRIPTION OF PARTICULAR EMBODIMENTS

Figure 1:
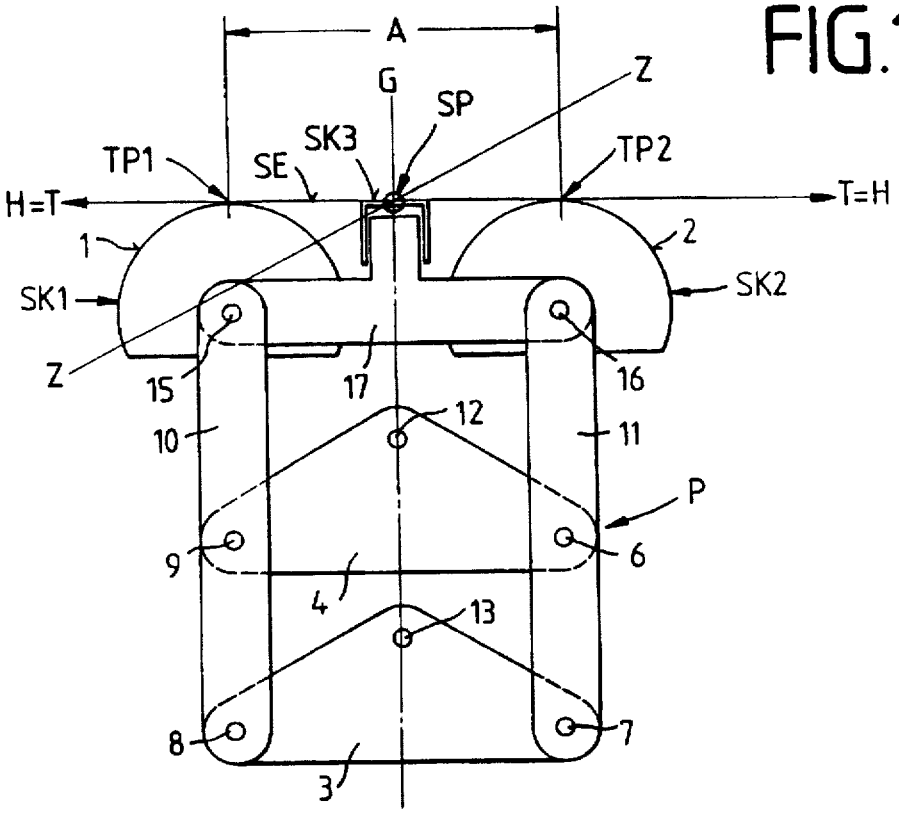

Referring now to FIG. 1 of the drawings, there are shown schematically two cutter heads SK1, SK2 configured as short-hair cutters extending parallel with each other in the longitudinal direction, as well as a cutter head SK3 configured as a long-hair trimmer arranged intermediate the cutter heads SK1 and SK2. The two upper cutters 1, 2 of the cutter heads SK1 and SK2 have their respective ends coupled to a parallelogram P whose transverse link members 3, 4 are pivotally coupled to two bars 10, 11 extending parallel with a vertical straight line G by means of pivot bearings 6, 7, 8 and 9, in addition to being pivotally jointed to the sides S of a common frame 14—see FIG. 3—by means of two further pivot bearings 12, 13 in order to effect or control a relative movement of the two cutter heads SK1, SK2 pivotally jointed to the upper ends of the bars 10, 11 by means of pivot bearings 15, 16. The cutter head SK3 is pivotally jointed to the two pivot bearings 15, 16 by means of a lever 17.

The tangent plane connecting the two arcuate cutter heads SK1 and SK2 is an imaginary plane referred to as shearing plane SE in the following. The common tangent T to the arcuate form of the cutter heads SK1 and SK2 determines with its tangent points TP1 and TP2 the transition from the shearing plane SE into the adjoining arcuate sections and, by the relative distance A of the tangent points TP1 and TP2, the width of the shearing plane SE whose extent in the longitudinal direction of the cutter heads SK1, SK2 is dependent on their length. A straight line G intersects the tangent T at right angles in the center of the distance A. Extending through the resulting point of intersection SP parallel with the elongate cutter heads SK1, SK2 and SK3 is the pivot axis Z. The cutter head SK3 pivotally coupled to the parallelogram P has its outer contour, which is of a planar configuration, tangent to the tangent T, that is, the shearing plane SE, executing with the tangent T, that is, the shearing plane SE, a pivotal movement about the axis Z, as shown, for example, in FIG. 2. On the application of a force acting from outside on the cutter heads SK1 and SK2, the two bars 10, 11 will move relative to and parallel with each other, as well as parallel with the straight line G by means of which the point of intersection SP for axis Z is determined and on which the pivot bearings 12 and 13 of the transverse link members 3 and 4 are arranged. On the application of a force acting from outside on at least one of the cutter heads SK1 or SK2, the pivot angle of the pivotally mounted cutter head SK3 corresponds to the respective angle B formed by the tangent T applied to the outer contours of the two outer cutter heads SK1 and SK2, that is, the shearing plane SE, and a horizontal straight line H intersecting the point of intersection SP. The horizontal straight line H is an auxiliary line by means of which the position of the relatively movable cutter heads SK1, SK2 is defined in the absence of outside forces acting thereon, that is, it characterizes the initial position of the cutter heads SK1, SK2 under no-load conditions.

Figure 2:
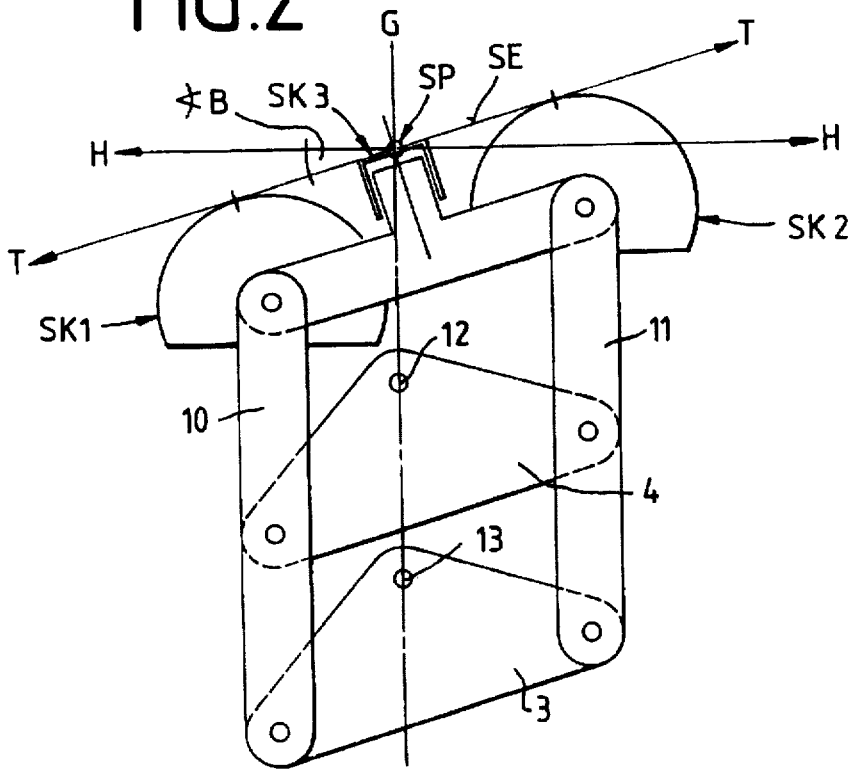
FIG. 2 shows the position of the cutter heads of FIG. 1 on the application of a force on one of the cutter heads.
Figure 3:
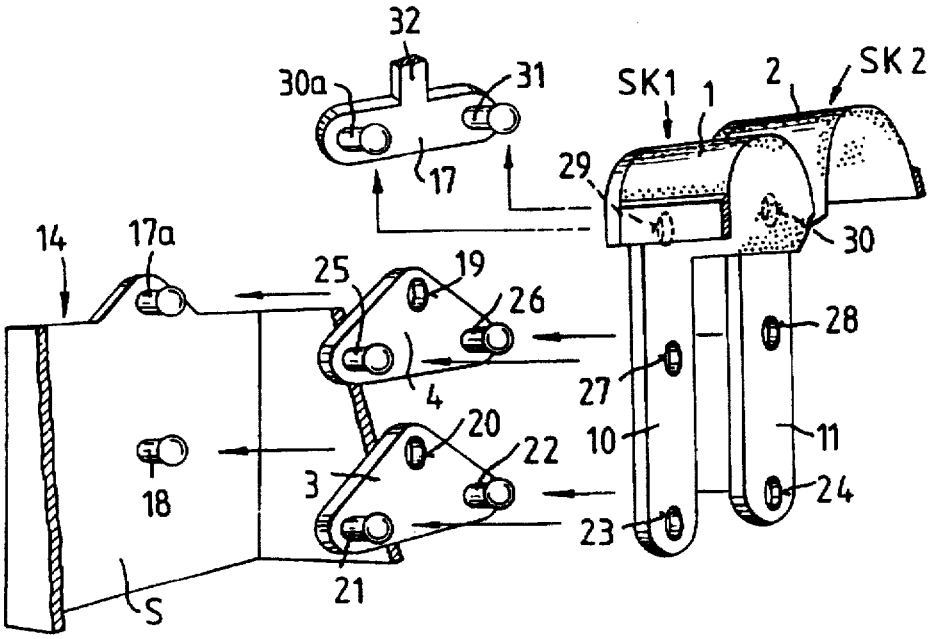
FIG. 3 shows details of the structure of a cutter head control arrangement of FIGS. 1 and 2.

FIG. 3 shows structural details of the configuration and arrangement of the parallelogram P controlling the cutter heads SK1, SK2 and SK3 of FIGS. 1 and 2. FIG. 3 shows an end wall S of a frame 14. Provided on the inside are two pins 17*a*, 18 which cooperate with respective bores 19, 20 of the transverse link members 3, 4 to form respective pivot bearings 12, 13. On the transverse link member 3, two pins 21, 22 are provided which cooperate with respective bores 23, 24 of the bars 10, 11 to form respective pivot bearings 7 and 8. Pins 25, 26 provided on the transverse link member 4 cooperate with respective bores 27, 28 provided in the bars 10, 11 to form respective pivot bearings 6 and 9. Further bores 29, 30 provided at the ends of the bars 10, 11 remote from the bores 23, 24 cooperate with respective pins 30a, 31 to form respective pivot bearings 15, 16. Mounted on the upper ends of the bars 10 and 11 are the upper cutters 1 and 2 of the cutter heads SK1 and SK2 movable relative to each other by means of the bars 10, 11, the upper cutters being shaving foils, for example.

Figure 4:
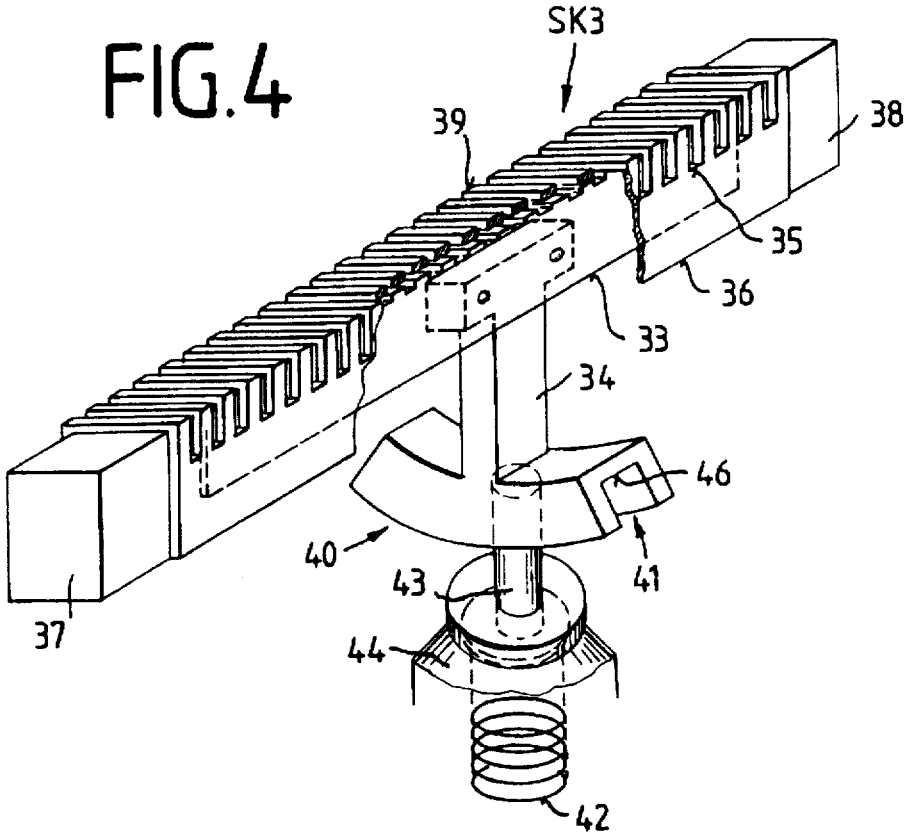
FIG. 4 shows the structure of a pivotally mounted long-hair trimmer with its drive elements.

Mid-way between the two pins 30*a*, 31, a mounting means 32 is provided on the lever 17 for securing the cutter head SK3 configured as a long-hair trimmer - see FIG. 4.

FIG. 4 shows an embodiment of a pivotally mountable cutter head SK3 including a coupling member 34 for pivoting and driving the associated inner cutter 33. The upper cutter 36 which is provided with a plurality of slots 35 has either end thereof secured to a respective supporting means 37, 38. In the embodiment of FIG. 3, the supporting means 37, 38 serve the function of securing the cutter head SK3 to the mounting means 32 of the respective levers 17 of the respective parallelograms P provided at the respective ends of the cutter heads SKI and SK2—see FIG. 7, for example. The upper cutter 36 is of a U-shaped configuration, its outer skin-engaging surface being of a planar structure to allow particularly effective insertion of the hair to be cut through the ridges 39 produced by the slots 35 into the cutting area formed by the upper cutter 36 and the inner cutter 33. The inner cutter 33 is coupled to the coupling member 34 formed integrally with a drive-transmitting member 40 arranged transversely to the direction of oscillation of the inner cutter 33. Formed within the drive-transmitting member 40 is a groove 41 engaged by a driving member 43 acted upon by a spring 42. The spring 42 and the driving member 43 are arranged in a housing 44 coupled directly or indirectly to a drive mechanism (not shown) provided in the housing 45 of the dry shaving apparatus—see FIG. 7 or FIG. 8. The spring 42 acts through the driving member 43 engaging within the groove 41 to maintain the coupling member 34 carrying the inner cutter 33 in resilient engagement with the inside of the upper cutter 36. The arcuate shape of the inside wall 46 of the groove 41 corresponds to the pivot arc of the cutter head SK3.

Figure 5:
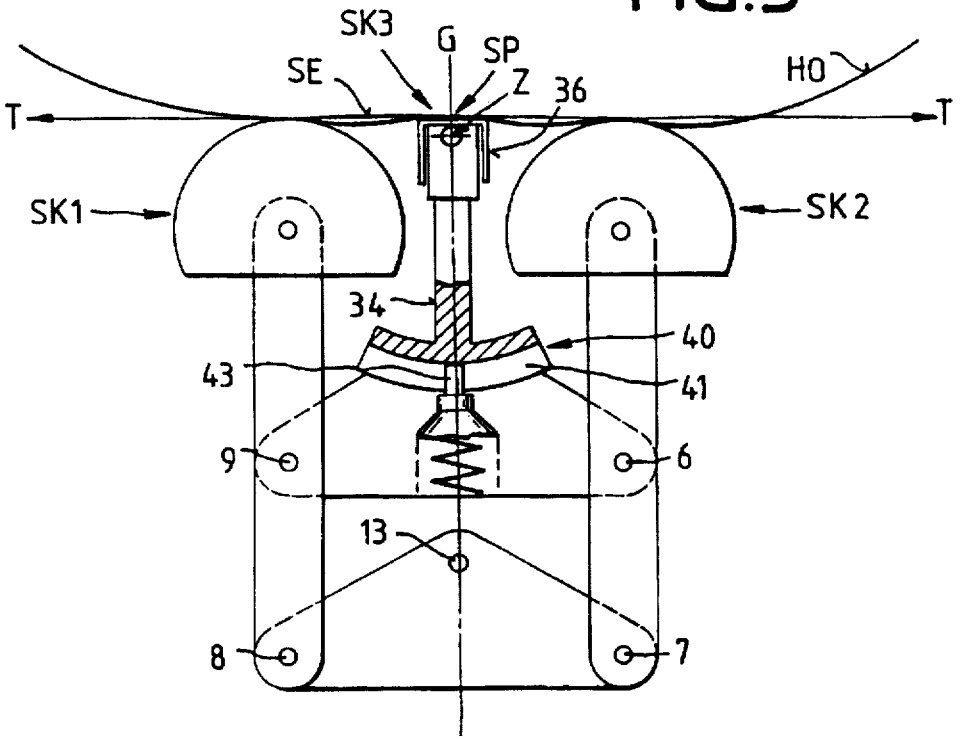
FIG. 5 is a schematic representation of a cutter head assembly controlled by a parallelogram and a pivotally mounted long-hair trimmer assembly associated therewith.
Figure 6:
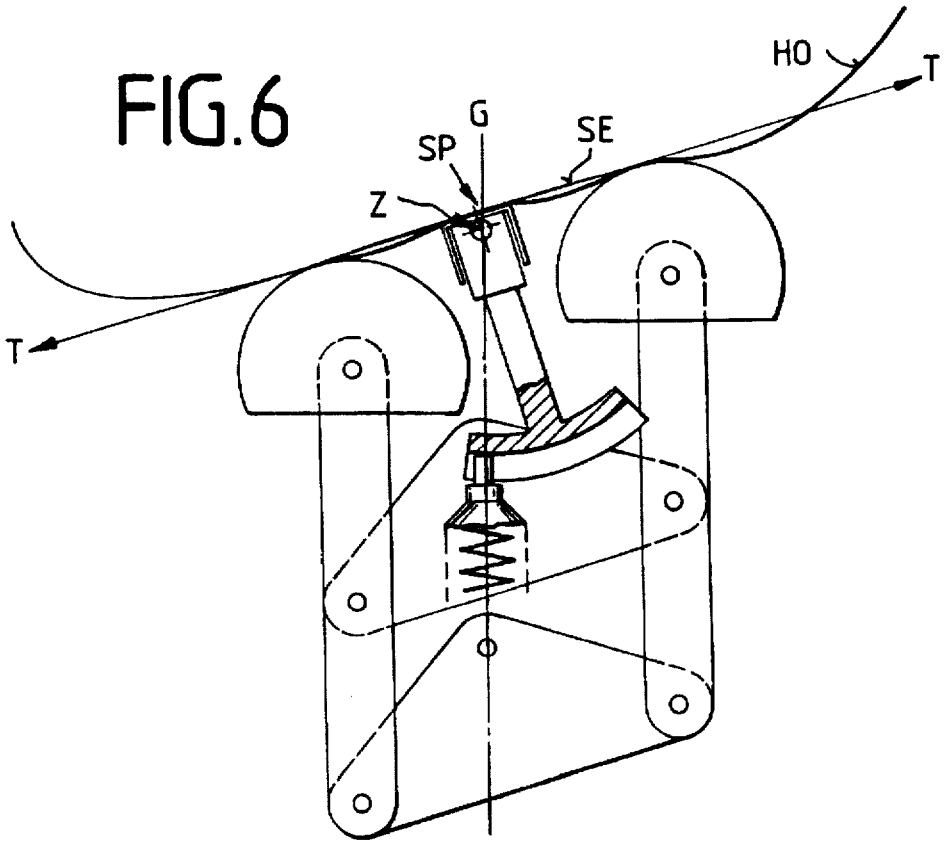
FIG. 6 shows the position of the cutter heads of FIG. 5 on the application of a force on one of the cutter heads.
Figure 7:
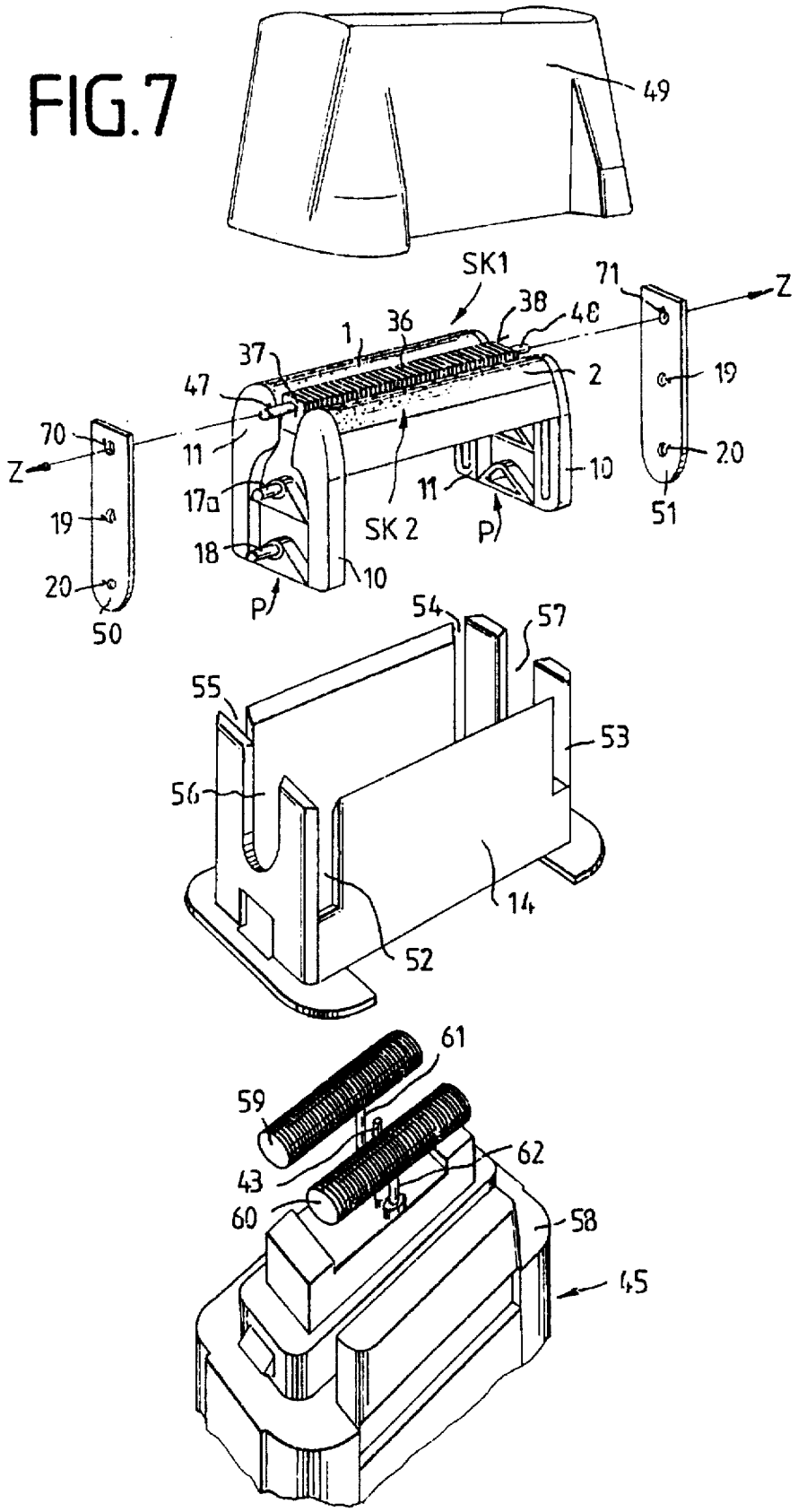
FIG. 7 is an exploded view of the upper portion of a shaving apparatus, with an auxiliary frame for receiving the cutter heads and a cutter head frame.

FIGS. 5, 6 and 7 illustrate a further embodiment of the dry shaving apparatus including a cutter head SK3 configured as a long-hair trimmer pivotal about the axis Z. In this embodiment, the cutter heads SK1 and SK2 configured as short-hair cutters have their respective ends coupled to a parallelogram P of which only one is shown schematically. The configuration of the cutter head SK3 disposed intermediate these two cutter heads SK1 and SK2 corresponds to the embodiment of FIG. 4. By means of bearing pins 47, 48 provided on the supporting means 37, 38 and engaging within respective bores 70 and 71 provided in the end plates 50, 51 of the frame 14, the cutter head SK3—see FIG. 7—is pivotally mounted in a frame 14 which is adapted to be seated on the housing 45 and is surrounded by a cutter head shell structure 49 or, alternatively, may also be a component part of the cutter head shell structure 49. The bores 19, 20 provided in the end plates 50, 51 serve to receive the pins 17*a*, 18, forming with these the pivot bearings 12, 13 for controlling the movement of the two cutter heads SK1 and SK2 relative to each other. The pivot bearings 6, 7, 8 and 9 indicated in the FIGS. 1, 5 and 6 are configured as film hinges in the embodiment of FIG. 7, forming with the bars 10, 11 and the upper cutters 1 and 2 of the two cutter heads SK1 and SK2 disposed thereon a constructional unit which, following insertion of the two pairs of bars 10 and 11 into the respective slots 52, 53 and 54, 55 and following insertion of the end plates 50, 51 into the respective slots 56, 57, are held and carried by the frame 14, together with the cutter head SK3 pivotally mounted in the bores 70, 71 of the end plates 50, 51 by means of the bearing pins 47, 48. The frame 14, complete with the cutter heads SK1, SK2, SK3, is seated down on the upper end 58 of the housing 45 and is detachably secured thereto by means of the cutter head shell structure 49 surrounding the frame 14. The inner cutters 59, 60 associated with the upper cutters 1 and 2 of the cutter heads SK1, SK2 are spring-mounted on respective drive pins 61, 62. As the complete frame assembly 14 is seated down, the spring-mounted driving member 43 will automatically engage the groove 41 of the drive-transmitting member 40—see FIGS. 4, 5 or 6.

In the embodiment of FIGS. 5, 6 and 7, the outside of the planar upper cutter 36 of the cutter head SK3 is tangent to the tangent T. In consequence, the axis Z about which the cutter head SK3 is pivotal lies a small amount below the tangent T on the straight line G, that is, below the point of intersection SP of the straight line G with the tangent T. Experience has shown that a displacement of axis Z at a specific distance to the point of intersection SP shown in, and described with reference to, FIGS. 1 and 2 is acceptable without appreciably impairing the pivotal movement of the cutter head SK3. In view of the numerous influence variables including, for example, the outer contour of the cutter head SK3, the friction of its upper cutter 36 relative to the skin, the bow-wave effect of the skin, the relative distance of the cutter heads SKI and SK2 and the like, the limits of the permissible relative distance of the axis Z to the point of intersection SP can be determined by practical tests for the individual embodiment concerned.

Figure 8:
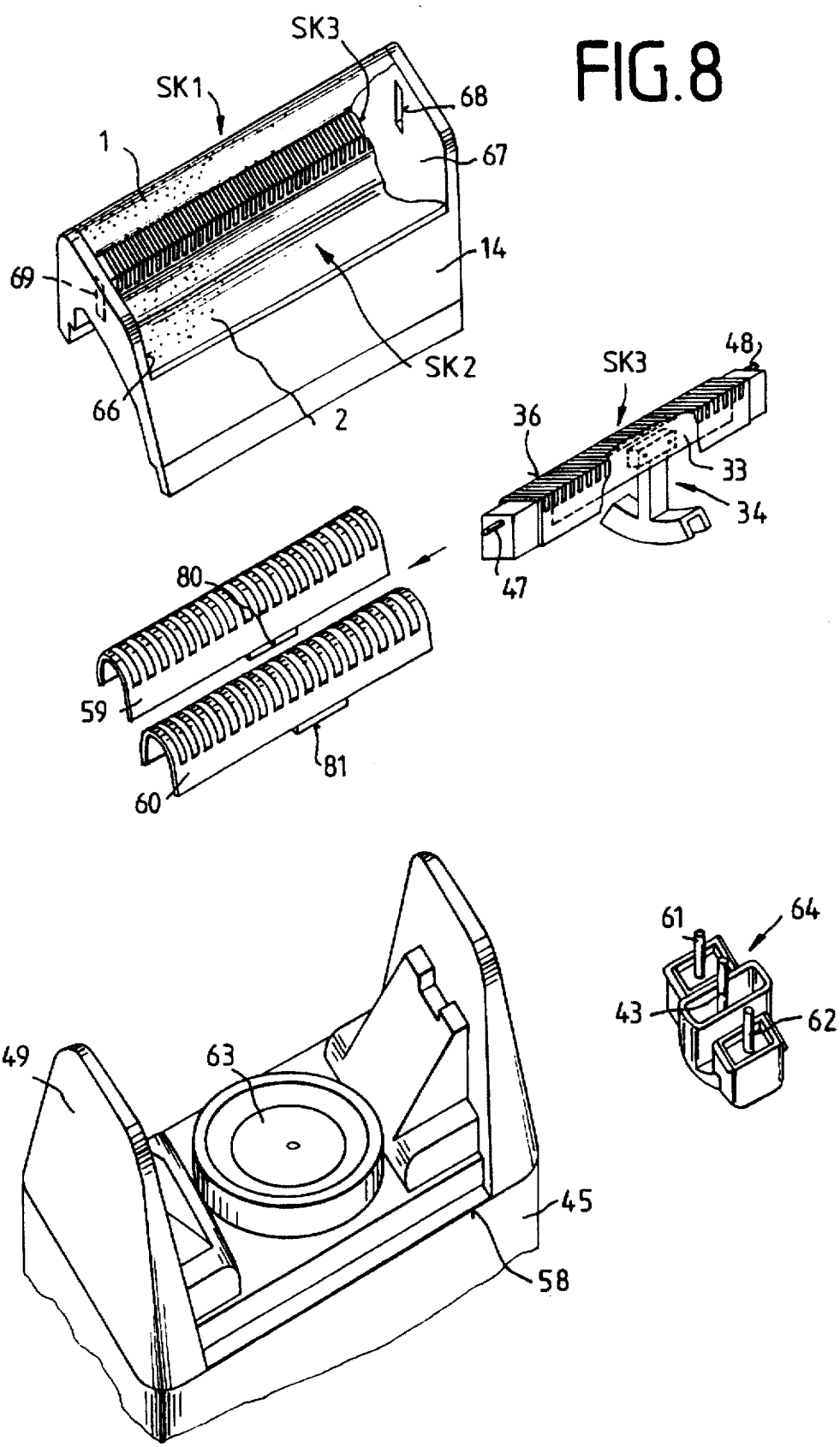
FIG. 8 is an exploded view of the upper portion of a shaving apparatus, with a cutter head shell structure and an auxiliary frame with three relatively movable cutter heads.

FIG. 8 shows in an exploded representation a further embodiment of a pivotally mounted head SK3. Detachably secured to the upper end 58 of the housing 45 is a cutter head shell structure 49. A driving member 63 coupled to the drive mechanism of the dry shaving apparatus transmits the driving motion through a coupling member 64 adapted to be coupled thereto and comprising three spring-mounted drive elements 61, 43 and 62 to the inner cutters 59, 33 and 60 of the three cutter heads SK1, SK2 and SK3 by means of coupling members 80, 34 and 81 provided on the inner cutters 59, 33 and 60.

Each of the upper cutters 1 and 2 of the cutter heads SK1 and SK2 configured as short-hair cutters is movably carried within the frame 14 adapted to be coupled to the cutter head shell structure 49, such as to ensure movement of the two cutter heads SK1 and SK2 relative to each other. An embodiment of such a movable arrangement of upper cutters 1 and 2 in a frame adapted to be coupled to a cutter head shell structure 49 is known, for example, from printed specification JP 4-1 32 581 A referred to in the introductory portion of this specification, reference to which is herewith expressly made. According to FIG. 5 of this known printed specification, the upper cutters 1 are each spring-mounted in a frame 14, such that on the application of different forces acting from outside on the upper cutters 1, the upper cutters 1, will each execute a movement relative to the respective other upper cutter 1. As this occurs, the upper cutters 1 will occupy a relative position to each other. The two upper cutters 1 being each spring-mounted, and considering the individual forces acting on the two upper cutters 1, 2, a distance X will result relative to a horizontal straight line H=tangent applied to the upper cutters under no-load conditions, that is, when the upper cutters 1, 2 are in their initial positions. This distance X which is dependent upon the individual force acting on the respective upper cutter 1, 2, will also result on the application of uniform forces acting from outside on the two upper cutters 1, 2, urging them, against the pressure of the respective springs provided, into the interior of the frame 14 in the direction of the housing 45 of the shaving apparatus. This relative movement of the upper cutters 1, 2 acts also against the pressure of the springs by means of which the respective inner cutters 33, 59, 60 are held in engagement with their associated upper cutters 36, 1, 2. The springs are provided between the coupling member transmitting the driving motion and the respective inner cutter 33, 59, 60.

Figure 9:
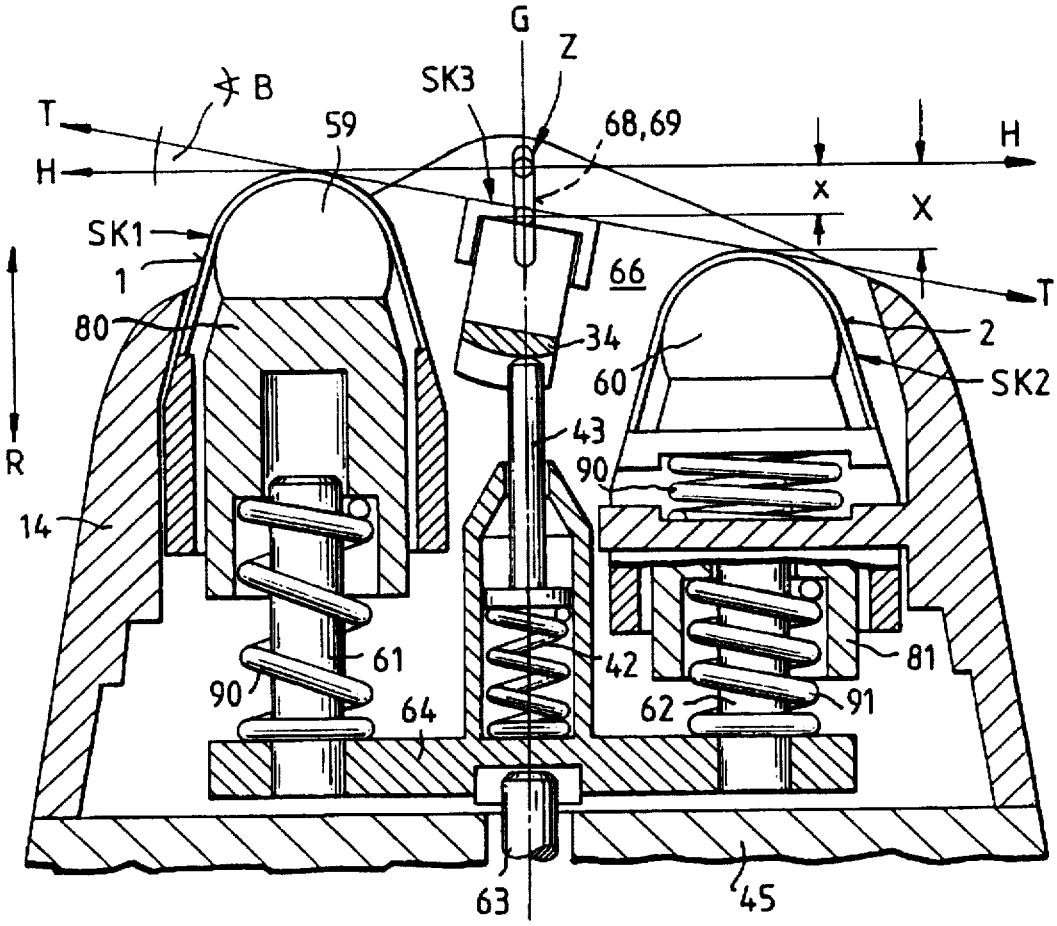
FIG. 9 is a schematic illustration of the arrangement of the three relatively movable cutter heads of FIG. 8, showing the pivotal mounting of the intermediate cutter head.

In the embodiment of FIGS. 8 and 9, the springs associated with the respective inner cutters 59, 33, 60 are provided in the coupling member 64, acting on the drive elements 61, 43, 62 or the coupling members 80, 34, 81.

An elongate recess 68, 69 extending in the vertical direction is provided in respective inside walls 66, 67 of the respective ends of the frame 14, the recesses serving to receive the respective bearing pins 47, 48 of the cutter head SK3 disposed intermediate the two relatively movable cutter heads SK1 and SK2.

The mounting of the cutter head SK3 by means of the bearing pins 47, 48 received in the two recesses 68, 69 ensures on the one hand the pivotal movement of the cutter head SK3 and, on the other hand, a movement of the cutter head SK3 into the interior of the frame 14 in the direction of the housing 45. Assuming the three cutter heads SK1, SK2, SK3 are in the non-load condition, that is, in their initial position as shown in FIGS. 8 and 9, the application of forces acting from outside on the upper cutters 1, 2, 36 will result in a corresponding movement of the cutter heads SK1, SK2 and SK3 from the common horizontal straight line H by a relative distance X to this horizontal straight line H, thus causing a displacement of the axis Z of the pivotal cutter head SK3. From this displacement of the axis Z and the pivotability of the cutter head SK3 about the axis Z, the pivot angle of the cutter head SK3 will automatically adapt to the respective angle B of the tangent T, that is, the shearing plane SE, because the disposition of the recesses 68, 69 in the frame 14 is such that, as becomes apparent from FIG. 9, a displacement of the tangent T, that is, the shearing plane SE, pivotal about the axis Z will occur in the direction of the housing 45 on the straight line G, in opposition to the pressure of the spring 42.

FIG. 9 shows schematically by way of example only one variant of the movement of three cutter heads SK1, SK2 and SK3 movable independently relative to each other. The cutter heads SK1 and SK2 are independently and relatively movably carried on a common coupling member 64, the movement being in opposition to the pressure of a respective spring 90, 91 acting on the upper cutters 1, 2 and the inner cutters 59, 60. The cutter head SK3 disposed intermediate the cutter heads SK1 and SK2 is movable within the recesses 68, 69 in the direction of the arrow R parallel with, and relative to, the cutter heads SK1 and SK2 in opposition to the pressure of the spring 42, and it is mounted so as to be pivotal about the axis Z. On the exertion of, for example, outside forces acting only on the cutter head SK2 and SK3 in the use of the dry shaver, the cutter head SK2 and the cutter head SK3 will move a corresponding amount X in the direction of the arrow R. From this movement results a corresponding displacement of the axis Z within the recesses 68, 69, as well as a pivotal movement of the cutter head SK3 whose outer contour/upper cutter will automatically adapt to the pivot angle which is determined by the angle B formed by the tangent T, that is, the shearing plane SE, applied to the outer contours of the two cutter heads SK1 and SK2, and the horizontal straight line H.

When forces act on all three cutter heads SK1, SK2 and SK3 (not shown) at the same time, the three cutter heads SK1, SK2 and SK3 will experience a corresponding displacement from the horizontal straight line H representing the initial position by a corresponding distance X in the direction of the arrow R, with the cutter head SK3, by virtue of its pivotal mounting within the recesses 68, 69, assuming a pivot angle corresponding to the respective angle B of the tangent T, that is, the shearing plane SE, applied to the outer contours of the two cutter heads SK1 and SK2.

An additional advantage of the embodiment of FIGS. 8 and 9 resides in that the cutter head SK3 movable in the direction of the arrow R against the pressure of a spring and pivotal about the axis Z is equally in a position to perform a movement relative to the neighboring cutter heads SK1 and SK2, being in particular capable of occupying a pivot position slightly below the pivot position of the shearing plane SE. This contributes to ensuring permanent engagement of the three cutter heads SK1, SK2 and SK3 with the skin to be shaved, in particular a continuous adaptation to continually changing facial contours to be shaved.

We claim:

1. A dry shaving apparatus comprises:

a housing structure, a support structure mounted to said housing structure, at least two elongated cutter heads (SK1, SK2) mounted to said support structure, said at least two elongated cutter heads spaced from one another and having longitudinal axes essentially parallel with each other, each said elongated cutter head comprising an outer cutter and an inner cutter for cutting short hair, said support structure supporting said two spaced elongated cutter heads such that, during use, said two spaced elongated cutter heads move relative to each other, and a further cutter head (SK3) for cutting long hair mounted to said housing structure and arranged intermediate said two elongated cutter heads (SK1, SK2), said further cutting head being pivotal about an axis (Z) extending parallel with and intermediate the longitudinal axes of said two elongated cutter heads (SK1, SK2).

2. The dry shaving apparatus of claim 1 wherein each said elongated cutter head has an outer surface, and said axis (Z) extends approximately through a point of intersection (SP) of first and second straight lines (T and G), where the first straight line (T) is a common tangent to said outer surfaces of said two elongated cutter heads (SK1, SK2), and the second straight line (G) intersects the first straight line at right angles at one half of a distance (A) between tangent points (TP1, TP2) at which the first straight line (T) contacts said outer surfaces of said two cutter heads (SK1, SK2).

3. The dry shaving apparatus of claim 2 wherein said first straight line (T) defines a shearing plane (SE) and said further cutter head is pivotally mounted on said housing structure such that application of an outside force on one of said two elongated cutter heads (SK1, SK2) causes said shearing plane (SE) and said further cutter head (SK3) to be pivoted about said axis (Z).

4. The dry shaving apparatus of claim 1, wherein said support structure includes a parallelogram structure and a lever.

5. The dry shaving apparatus of claim 4 wherein said further cutter head (SK3) is disposed on said lever.

6. The dry shaving apparatus of claim 1 wherein said support structure includes a parallelogram structure.

7. The dry shaving apparatus of claim 1 wherein said support structure includes a parallelogram structure and a frame structure, said frame structure being detachable from said housing structure, said further intermediate cutter head (SK3) is carried in said frame structure.

8. The dry shaving apparatus of claim 1 wherein said further cutter head (SK3) is mounted to said housing structure to move relative to and essentially parallel with at least one of said two elongated cutter heads (SK1, SK2).

9. The dry shaving apparatus of claim 8 wherein each said elongated cutter head has an outer surface, and said further cutter head (SK3) is configured so that the position of said axis (Z) of said further cutter head (SK3) is variable in relation to a tangent (T) common to said outer surface of said two elongated cutter heads (SK1, SK2) on the exertion of an outside force acting on said further cutter head (SK3).

10. The dry shaving apparatus of claim 9 wherein the tangent (T) defines a shearing plane (SE) and said further cutter head (SK3) is configured so that, on the application of an outside force acting on at least one of said cutter heads (SK1, SK2, SK3), a pivot angle of said further cutter head (SK3) relative to a horizontal straight line (H) corresponds substantially to an angle (B) formed by the tangent (T) and the horizonal straight line (H).

11. The dry shaving apparatus of claim 1 wherein said further cutter head (SK3) includes an upper cutter of substantially u-shaped configuration.

12. The dry shaving apparatus of claim 1 wherein said further cutter head (SK3) includes coupling means operable to pivot in a direction transverse to the longitudinal axes of said two elongated cutter heads (SK1, SK2).

13. The dry shaving apparatus of claim 1 further including a driving member for driving said further cutter head (SK3), and said support structure includes a coupling structure on which said two elongated cutter heads (SK1, SK2) are arranged.

14. The dry shaving apparatus of claim 1 wherein said support structure includes three coupling members, each of said cutter heads (SK1, SK2, SK3) is associated with one of said coupling members.

15. The dry shaving apparatus of claim 1, wherein said support structure includes a common coupling structure on which said two elongated cutter heads (SK1, SK2) are arranged.

16. The dry shaving apparatus of claim 1 wherein said housing structure includes an end wall structure defining bores and said further cutter head (SK3) includes a bearing pin structure received in said bores.

17. The dry shaving apparatus of claim 1 wherein said housing structure includes an end wall structure defining elongated recesses, and said further cutter head (SK3) includes a bearing pin structure received in said recesses.

18. The dry shaving apparatus of claim 2 wherein said axis (Z) extends through said point of intersection (SP).

19. The dry shaving apparatus of claim 1 wherein said support structure supports said two spaced elongated utter heads such that, during use, said two spaced elongated cutter heads move relative to each other and in an up and down direction relative to the housing structure.

* * * * *